United States Patent [19]

Takamoto et al.

[11] Patent Number: 4,613,084

[45] Date of Patent: Sep. 23, 1986

[54] PROCESS FOR PRODUCING A COAL-WATER SLURRY

[75] Inventors: Shigehito Takamoto; Kazunori Shoji; Nobuyasu Meguri; Yoshinori Ohtani; Hirofumi Kikkawa; Yasuyuki Nishimura; Hiroyuki Kaku, all of Kure; Masayasu Murata, Ohtemachi, all of Japan

[73] Assignee: Babcock-Hitachi Kabushiki Kaisha, Tokyo, Japan

[21] Appl. No.: 625,245

[22] Filed: Jun. 27, 1984

[30] Foreign Application Priority Data

| | | | |
|---|---|---|---|
| Jun. 28, 1983 | [JP] | Japan | 58-115246 |
| Jul. 5, 1983 | [JP] | Japan | 58-121041 |
| Sep. 7, 1983 | [JP] | Japan | 58-163328 |
| Sep. 30, 1983 | [JP] | Japan | 58-182510 |
| Sep. 30, 1983 | [JP] | Japan | 58-182512 |

[51] Int. Cl.[4] ..... B02C 19/12

[52] U.S. Cl. ..... 241/16; 44/51; 241/21; 241/22; 241/24; 241/29; 241/72

[58] Field of Search ..... 241/21, 29, 70, 71, 241/72, 101 D, 80, 87, 184, 153, 16, 24, 22; 44/51

[56] References Cited

U.S. PATENT DOCUMENTS

| | | | |
|---|---|---|---|
| 2,620,987 | 12/1952 | Kennedy | 241/72 X |
| 2,754,067 | 7/1956 | Klugh | 241/21 X |
| 3,117,733 | 1/1964 | Cleeman | 241/21 |
| 3,459,380 | 8/1969 | Kartman . | |
| 3,993,252 | 11/1976 | Ito et al. | 241/21 |
| 4,288,166 | 9/1981 | Nakabayashi et al. | 241/24 X |
| 4,500,041 | 2/1985 | Nakaoji et al. | 241/21 X |

*Primary Examiner*—Mark Rosenbaum
*Attorney, Agent, or Firm*—Beall Law Offices

[57] ABSTRACT

A process for producing a coal-water slurry having a high coal concentration (generally 60 to 80% by weight or more) and a lower viscosity, at a lower cost and with a smaller amount of dispersing agent added is provided, which process is directed to a process for producing a high concentration coal-water slurry by feeding coal, water and a dispersing agent into a wet, continuous ball mill and wet-milling them, characterized by feeding the dispersing agent in a multi-stage manner along the milling direction of coal within the ball mill.

15 Claims, 18 Drawing Figures

PROCESS FOR PRODUCING A COAL-WATER SLURRY

BACKGROUND OF THE INVENTION

1. Field of the Invention

This invention relates to a process for producing a high concentration coal-water slurry and more particularly it relates to a process for producing a stabilized, high concentraion coal-water slurry according to a multi-stage, liquid-feed process.

2. Description of the Prior Art

Recently, coal has come to be actively utilized in place of petroleum mainly at thermal power stations. However, coal as a solid fuel is difficult to handle and also the proportion of its transport cost upon the overall cost of coal is great. Thus, development of techniques for preparing a coal slurry to thereby handle it in liquid form has been energetically carried out.

One of the techniques is directed to COM (Coal and Oil Mixture) which is a mixture of heavy oil with coal. In the case of COM, however, the ratio by weight of heavy oil to coal is about 1:1; hence COM cannot be regarded as a completely oil-free fuel, and also its merit of cost is small. Further, methacoal which is a mixture of methanol with coal is so expensive that it has not yet been practically used. Whereas CWM (Coal and Water Mixture) which is a mixture of coal with water is fully practical in respect of cost, it has recently been greatly noted. For producing this CWM, there has generally been employed a process of adding water to coal and milling the mixture in a wet manner. However, a problem has been raised that if the proportion of the water content in CWM is high, its thermal efficiency at the time of combustion is reduced, while if it is low, the viscosity of CWM rises to increase the pressure loss at the time of its transportation. Further, since CWM consists of coal particles and water, an additional problem as to storage has been raised that coal particles settle with lapse of time and separate from water. In order to overcome these drawbacks, the particle size distribution of coal particles is adjusted and further an additive (dispersing agent) is added to CWM to produce a CWM having a high coal concentration, a low viscosity and a good stability. Namely, in order to produce a slurry having a high coal concentration, a low viscosity and a good stability, it has been said to be preferred to add an additive to coal and water to be fed and mill the coal to such a particle size that a maximum packing fraction can be given. However, such high concentration wet milling has drawbacks that if an additive is added all at once, a superfluous amount of the additive is adsorbed onto the coal surface to increase the amount of the additive consumed, and since additives are expensive, their addition in a large amount increases the cost of product slurry. Thus, it has become a problem to be solved to use an additive in an amount as small as possible and yet produce a stabilized, high concentraion slurry.

The object of the present invention is to provide a process to overcome the above-mentioned drawbacks of the prior art and to produce a coal-water slurry having a high coal concentration (generally 60 to 80 % by weight or more) and a lower viscosity, at a lower cost and with a smaller amount of an additive used.

SUMMARY OF THE INVENTION

The present invention resides in a process for producing high concentration coal-water slurry by feeding coal, water and a dispersing agent into a wet, continuous ball mill and subjecting them to wet milling, which process comprises feeding the dispersing agent in a multi-stage manner along the milling direction of coal within the ball mill.

DESCRIPTION OF THE PREFERRED EMBODIMENTS

The dispersing agent as the additive used in the present invention may be a surfactant having a surface-active function or a function of dispersing coal particles. Examples thereof are anionic dispersants such as naphtalenesulfonic acid, orthophosphoric acid, polyphosphoric acids expressed by $H_{n+2}P_nO_n$ ($n \geqq 2$) or $H_nP_nO_n$ ($n \geqq 3$), tartaric acid, oxalic acid, citric acid, ethylenediaminetetraacetic acid, ligninsulfonic acid, salts or condensates of the foregoing acids, quebracho-tannin and other tannins and metal salts of carboxymethyl cellulose. The amount thereof added has no particular limitation, but it is generally 3% by weight or less, preferably 1.5% by weight or less. The ultimate pH value of the coal-water slurry is preferred to be 7 or more, and as the pH adjustor therefor, sodium hydroxide, calcium hydroxide, barium hydroxide, sodium carbonate or the like is added. Such additives are added in the form of powder or solution.

Figure 1:
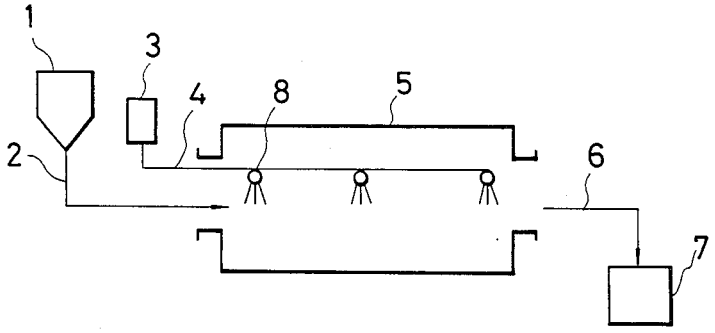
FIGS. 1, 2, 3 and 5 each show a view illustrating the flow of materials in the apparatus for producing a coal-water slurry, of the present invention wherein a wet ball mill is used.

FIG. 1 shows a conceptual view of an apparatus for producing a coal-water slurry wherein an embodiment of the present invention is shown. In this figure, a wet, continuous ball mill 5 consists basically of a horizontally rotating cylinder, in which cast iron balls are filled. When the mill is rotated, the balls are lifted along its inner wall and freely drop or roll down on the surface of the contents. At that time, coal particles are placed between the balls or between the balls and the inner wall surface of the mill and milled by friction or impact. In this figure, the balls and a means for rotating the mill are not shown. Coal stored in a coal hopper 1 is fed into the ball mill 5 through a metered coal-feeding pipe 2, and at the same time, water and an additive (dispersing agent) are fed into the same ball mill 5 from a liquid feed tank 3 through a liquid feed pipe 4. The coal concentration at that time is in the range of 50 to 80% (preferably 60 to 70%). The additive-containing liquid is fed into the mill in three divided portions through three liquid feed nozzles 8 provided along the coal milling direction (the advancing direction) within the mill, and a coal-water slurry (CWM) formed in the mill is sent through a slurry discharge pipe 6 to a slurry-adjusting tank 7 and if necessary, further sent to a combustor, etc. by means of a slurry pump or the like.

When coal is milled within the wet ball mill, since coal particles in the vicinity of the inlet of the mill have a large diameter and a small surface area, the amount of the additive adhered onto the surface thereof is small. Since the diameter of coal particles becomes small as they come close to the exit of the mill and hence the surface area increases, the amount of the additive adhered onto the surface thereof increases. Thus, when the additive (dispersing agent) is fed in a multi-stage manner along the milling direction of coal within the mill, the amounts of the dispersing agent in advance of its addition are adjusted to those corresponding to the particle diameter or the surface area of coal at each of the stages of milling. Then it is possible to reduce the amount of the additive to a large extent. Since fresh dispersing agent attaches onto the surface of coal particles just after the milling, adhesion of coal particles onto coal particles is effectively carried out.

Although FIG. 1 shows an embodiment of liquid feed in a manner of three divisions, the liquid feed may be carried out in a manner of two divisions or multiple divisions correspondingly to coal properties or the size of mill, or in the case of the muli-stage feed, the amount of the additive may be stepwise increased with the increase in the surface area of particles.

Figure 2:
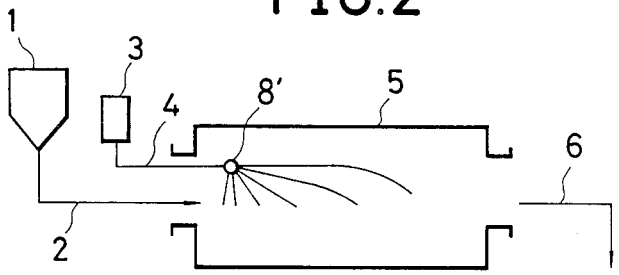

FIG. 2 illustrates a liquid feed method wherein an additive liquid is dispersed within a mill by means of one liquid feed nozzle 8' capable of broadly spreading the additive liquid. According to the method, it is possible to reduce the number of liquid feed nozzles to thereby simplify the apparatus.

Figure 3:
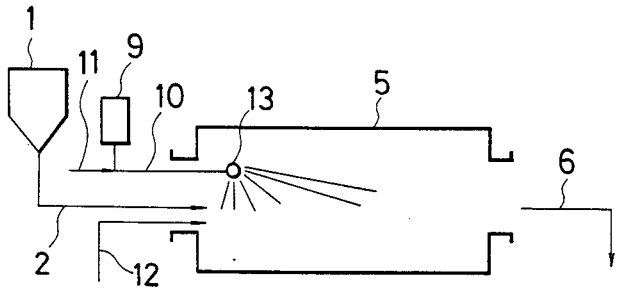

FIG. 3 illustrates a method of feeding an additive in the form of powder. The additive is fed into a mill 5 from an additive tank 9 through an additive feed pipe 10 and sprayed through an additive nozzle 13. At that time, air through an air feed pipe 11 is used as a carrier gas. Further, water is fed into the mill through a water feed pipe 12. According to this method, since the additive and water are separately fed, it is possible to keep the concentration of water content in the mill constant.

As for the mills shown in FIGS. 1, 2 and 3, it is possible to arrange two or more mills in series to thereby provide a multi-stage wet milling process. Further, it is possible to provide a classifier at the exit of the mill where coal particles having diameters larger than a definite particle diameter are separated by classification and returned to the inlet of the mill.

Figure 4:
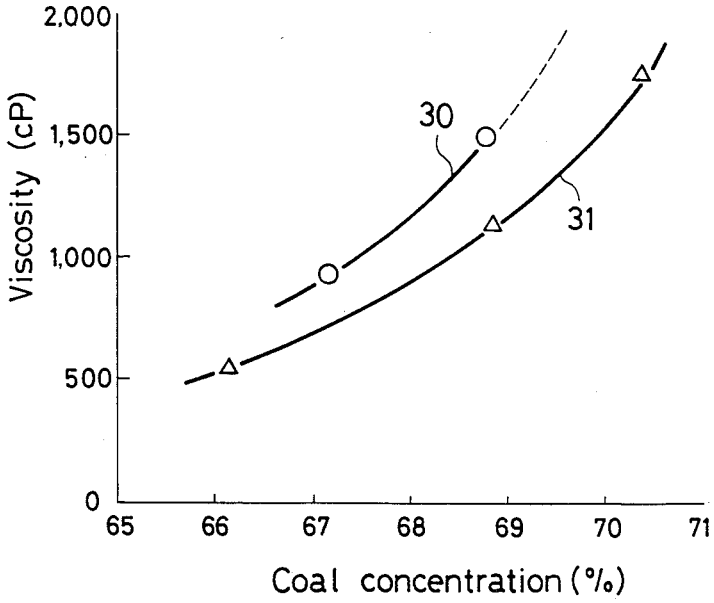
FIG. 4 shows a chart illustrating experimental results (relationship between viscosity and coal concentration) in the cases of a single stage addition and a multi-stage addition by means of a small type wet ball mill.

FIG. 4 shows experimental results in the cases where a wet ball mill (950 mm$\phi \times$1,900 mm length) shown in FIG. 1 is employed, Miike (Japan) coal is used as raw material coal and an additive (dispersing agent) is added in a definite total amount, in a one-stage manner (additive concentration 0.4%) (comparative example) and in a three-stage manner (additive concentrations at each stage as viewed from the inlet of the mill being 0.1%, 0.2% and 0.1%, respectively) (the present invention). In the figure, numeral 30 represents the case of a one-stage addition and 31, the case of a three-stage additional. As apparent from the results, the three-stage addition results in a higher coal concentration in the case of the same slurry viscosity. Namely, when a CWM having the same coal concentration and the same viscosity is produced, it is seen that the multi-stage addition of an additive permits the amount of additive to be smaller.

Figure 5:
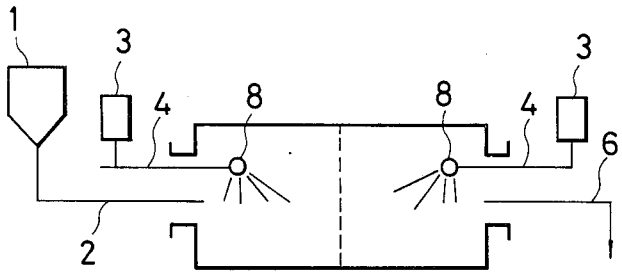

FIG. 5 shows an embodiment where the present invention is applied to a multi-compartment mill. In this case, two liquid feed nozzles 8 are provided so that the liquid can be fed at two locations on the inlet side and the exit side of the mill.

In the present invention, in order to mill coal so as to distribute the coal particle sizes within a broad range and thereby raise the packing density, to thereby obtain a high concentration coal-water slurry, it is most preferred to continuously carry out the ball milling by stepwise varying the ball diameter from the larger to the smaller in this order, and at the same time carry out the addition of the dispersing agent in a manner of two or more divisions with lapse of time, as described above. In this case, the balls wear out at each stage and its size is reduced. So, balls having diameters smaller than the definite diameter of the smallest ball at each stage pass through holes of the partition plate and move to the next stage. Further, in the case of a coal having a particularly inferior grindability (Hardgrove grindability index (HGI) being low), limestone is added and the mixture is milled to give a coal-water slurry having a high concentration and a low viscosity.

Figure 6:
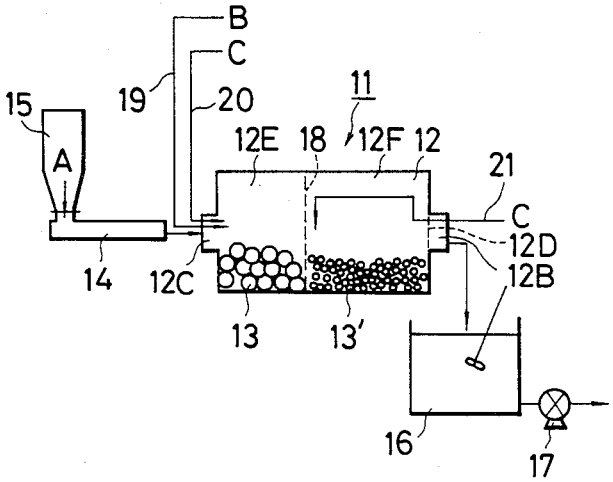
FIG. 6 shows a view illustrating the whole constitution of an apparatus for producing a coal-water slurry, wherein a multi-compartment mill is used as the wet ball mill of the present invention.

FIG. 6 shows a detailed view illustrating an apparatus for producing a coal-water slurry, of the present invention wherein a multi-compartment ball mill of the present invention is employed. In this figure, a cylindrical body 12 of a ball mill 11 is divided by a partition plate 18 using a screen or a grate into a primary compartment 12E and a secondary compartment 12F. A feeder for raw material coal 14 is connected to the mill 11 at the inlet 12C thereof on the side of the primary compartment 12E, and a water feed pipe 19 and a primary feed pipe for a dispersing agent liquid 20 are passed through the inlet of the mill 12C and inserted into the primary compartment 12E. The primary compartment 12E of the mill 11 is filled with a group of balls 13 having diameters within a definite range (e.g. about 64~41 mm) and the secondary compartment 12F is filled with balls 13' having diameters within a difinite range (e.g. 40~12 mm) smaller than those of the balls of the primary compartment 12E. The diameter of a number of holes of the partition plate 18 is made somewhat smaller (e.g. 40 mm) than the smallest diameter (41 mm in the above example) within the ball diameter range difined for the balls in the primary compartment 12E. Further, a grate 12D at the exit 12B of the mill is provided with holes having a diameter (e.g. 11 mm) somewhat smaller than the smallest diameter defined as in the case of the secondary compartment 12F. Further, a secondary feed pipe for a dispersing agent liquid 21 is inserted into the secondary compartment 12F via the exit of the mill 12B. An adjusting tank 16 is provided below the exit of the mill 12B, and a product slurry is transferred to the next step by means of a pump 17.

In the apparatus having the above structure, roughly ground coal A (e.g. particle diameter: 5~19 mm or smaller) is quantitatively fed to the primary compartment 12E of the ball mill 11 through the feeder for raw material coal 14. Water B and a dispersing agent C are then fed to the primary compartment 12E through the water feed pipe 19 and the primary feed pipe for a dispersing agent liquid 20, so as to give a definite high coal concentration (e.g. about 75~85%) (on the basis of dry coal) and also so that the amount of the dispersing agent C added can be a definite part of the total part by weight (e.g. 0.3 part by weight or less) based on 100 parts by weight of coal (on the basis of dry coal). The dispersing agent C may be in the form of liquid or powder, or diluted with water in order to ease the metering of its amount added. In the primary compartment 12E of the ball mill 11, when the coal concentration of the slurry D is higher than those in the prior art and balls of larger diameters 13 than those in the prior art are used, a broad particle size distribution including small particle diameters is formed. Further, since balls of larger diameter 13 are used, it is possible to efficiently mill coarse particles containing larger coal particles (e.g. 5~10 mm) than those in the prior art. Further, fresh surface of coal particles fomed by milling is wetted with water in advance of reaching the secondary compartment 12F. Coal particles thus milled by balls of larger diameter in the primary compartment 12E pass through the holes of the partition plate 18 and move to the next secondary compartment 12F. In the secondary compartment 12F, a residual part of the dispersing agent (e.g. 0.3 part by weight or less) having subtracted the part of the agent added within the primary compartment 12E from the total part by weight of the agent based on 100 parts by weight of coal is added through the secondary feed pipe for a dispersing agent liquid 21, to efficiently act on the wet coal particle and reduce the slurry viscosity. Coal particles having further reduced particle sizes in the secondary compartment 12F are efficiently milled by balls of small diameter 13'.

During a long term operation of the ball mill 11, the diameter of balls 13 is reduced due to wear. In the present invention, balls 13 which have worn in the primary compartment 12E and have had a smaller diameter than the definite diameter of the holes of the partition plate 18 pass through the holes and naturally move to the secondary compartment 12F, and balls 13' which have worn in the secondary compartment 12F and have had a smaller diameter pass through the grate 12D at the exit of the mill and are naturally discharged from the mill 11. Thus, in order to compensate the amount of the wear loss, when balls 13 having the largest diameter are introduced into the primary compartment 12E through its inlet 12C, the diameters of balls 13 and 13'in the respective compartments form a distribution according to the following equation (1) and are automatically controlled to stabilize development of the milling effectiveness in the present invention. The distribution of ball diameter in the ball mill is presented by the equation (1) where dm means a maximum ball diameter, M means weight fraction of balls smaller than the balls having a diameter d.

$$M=(d/dm)^{3.8} \quad (1)$$

(F.C. Bond, "Crushing and Grinding Calculations", Allis-Charmers Publication 07R9235B, 1961)

According to the above embodiment, for example, it is possible to produce a high concentration coal-water slurry containing coal particles A of a particle size at the mill exit 12B of 70 to 85% in terms of 200 mesh pass and having a viscosity of 2,000 CP or less and a coal concentration of about 70 to 80% on the basis of dry coal, with a dispersing agent in an amount of about 50% or less of those in the prior art and at a power cost required for the mill which is about 5 to 10% less than those in the prior art. When a high concentration coal-water slurry is produced, the particle size distribution of a coal having an inferior grindability (i.e. small HGI) has a large value of the gradient $\gamma$ of the particle size distribution after a single milling and hence a large value of the distribution coefficient (i.e. a narrow width of the particle size distribution) even when coal is milled in a high concentration; hence it is often difficult to make the slurry concentration higher. According to the prior art, when a coal having a HGI of 50 or less is used, it is impossible to produce a slurry having a solids concentration of 70% or more and a viscosity of 2,000 CP or less.

Figure 7:
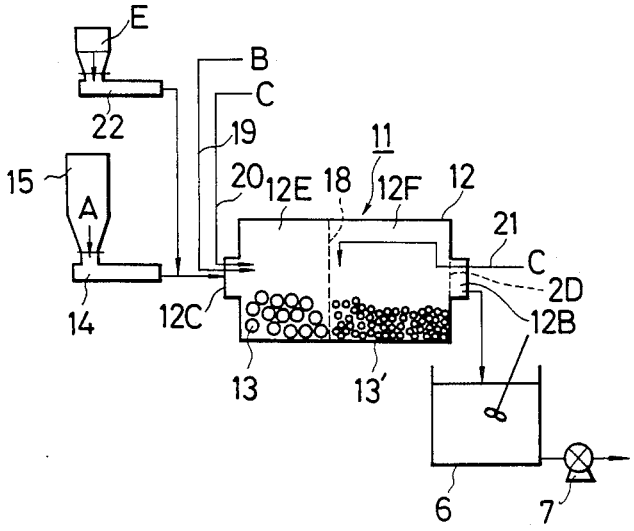
FIG. 7 shows a view illustrating the whole constitution of an apparatus for producing a coal-water slurry wherein an embodiment of the present invention of feeding limestone together with coal is shown.

FIG. 7 shows a view illustrating the system of an apparatus for producing a coal-water slurry suitable for producing a coal-water slurry having a high concentration and a low viscosity, from the above-mentioned coal having an inferior grindability. This apparatus is the same as that shown in FIG. 6 except that a limestone feeder 22 for feeding limestone E to the primary compartment 12E of the ball mill 11 is provided. In this figure, coal A, water B and a dispersing agent C are fed to the primary compartment 12E as in the case of FIG. 6, and further, limestone roughly ground to e.g. about 5 to 10 mm or less is fed to the mill exit 12C through the limestone feeder 22, in an amount of e.g. about 0.1 to 5 parts by weight based on 100 parts by weight of coal (dry coal basis), and mixed with coal and milled together therewith, and then a product slurry having a high concentration and a low viscosity flows out of the mill exit 12B. The reason that limestone is used is as follows: since limestone has a good grindability, it is very easily crushed as compared with coal; hence when a coal having an inferior grindability is wet-milled in a high concentration, if a small amount of limestone is added and mixed with the coal and milled together therewith, fine powder is formed from limestone to fill the interstices between coal particles and hence increase the packing density whereby it is possible to make the slurry concentration higher and also make the slurry viscosity lower. In this case, for example, a slurry having a viscosity of 2,000 CP or less in a concentration of 70% is obtained from a coal having a HGI of 50 or less. According to the above embodiment, in addition to the effectiveness of increasing the concentration, reducing the viscosity and reducing the power comsumption, there is obtained an effectiveness specific to limestone as an agent for adjusting the particle size distribution of coal particles, i.e. an effectiveness of raising the concentration and reducing the viscosity, and further there is an advantage that limestone contained in the coal-water slurry functions as a desulfurizing agent when the coal slurry is directly burned.

In the above embodiment, limestone is fed to the primary compartment 12E, but it may be fed to the secondary compartment 12F by connecting the limestone feeder 22 to the secondary compartment 12F in FIG. 7. In general, limestone may be fed to the primary compartment or to at least one of the secondary compartment and the following. Further, limestone may be fed in the form of a limestone-water slurry. Furthermore, other additives than limestone may be used so long as they are more easily milled than coal.

FIGS. 6 and 7 both illustrate a ball mill 11 consisting of two compartments, but a ball mill consisting of three or more compartments may be employed. In this case, the respective millings at each stage may be carried out with balls having a diameter suitable to the respective particle sizes of coal particles at each stage which are successively reduced from the inlet of the mill toward its exit. Further, if such an operation is carried out that the coal-water slurry flowing out of the exit of the ball mill is classified by means of a classifier such as vibrating sieve, and a slurry containing coal particles coarser than those of a definite particle size is returned to the primary compartment of the ball mill, while a slurry containing coal particles of a definite particle size or smaller is taken out as product, then it is possible to raise the efficiency of product without forming useless coal.

Figure 8:
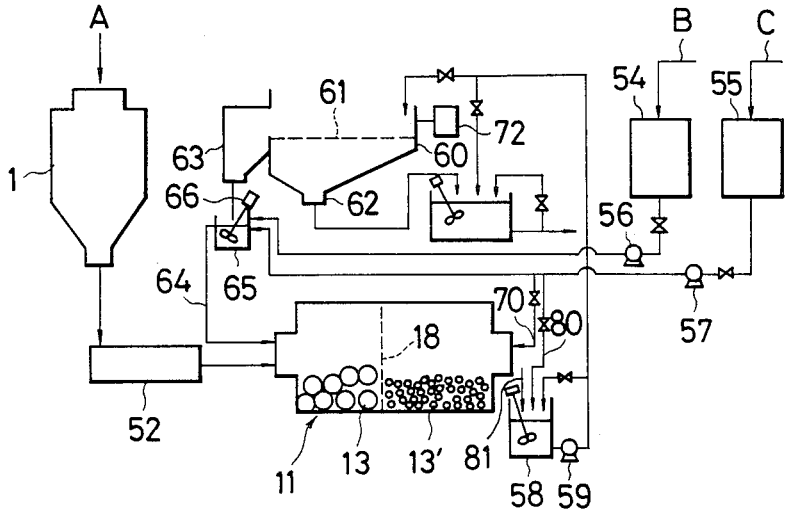
FIG. 8 shows a view illustrating as another embodiment of the present invention, an apparatus system wherein coarse particles contained in a coal-water slurry (CWM) leaving the mill are separated and recycled to the mill.

FIG. 8 shows a view illustrating another embodiment of the present invention wherein a multi-compartment mill is employed. In this figure, coal A is fed from a coal hopper 1, via a coal feeder 52 into a mill 11. Water B and a dispersing agent C are metered and fed from the respective tanks 54 and 55 to a recovery tank 65 by means of the respective pumps 56 and 57, then mixed with coarse particles separated at a coarse particle-separator 60, by means of a stirrer 66, and fed in the form of spray from the recovery tank 65 via a recovery pipe for coarse particle slurry 64 into the mill 11. The mill 11 is partitioned by a partition plate 18 such as a screen into two compartments 13 and 13' in which balls having different diameters relative to the respective compartments are filled. Namely, in this case, the primary compartment 13 is filled with balls of a larger diameter of about 75~40 mm, while the secondary compartment 13', with balls of a smaller diameter of about 40~12 mm. A slurry passing through the partition plate 18 is efficiently milled by the balls of a smaller diameter in the secondary compartment 13', and further, the surface of coal particles are efficiently wetted with a dispersing agent C freshly added through a liquid feed pipe 70, to make the slurry viscosity lower. The slurry discharged from the mill 11 is mixed with a separately fed dispersing agent or particles of a dispersing agent, in a tank 58, by means of a stirrer, whereby its viscosity is further reduced. Correspondingly to the fact that milling of particles creates fresh surfaces, a dispersing agent or its solution is added little by little in a multistage manner inside and outside the mill, and effectively mixed with particles, and it is possible to reduce its amount used. CWM produced in the mill 11 is then introduced in a slurry tank 58, further adjusted, if necessary, by adding a dispersing agent and water, etc. through fed pipes 80 and 81 and then placed in an apparatus for separating course particles 60 by means of a pump 59. In this apparatus 60, a screen 61 is provided which is further provided with a vibration generator 72 for imparting vibration or ultrasonic waves to the screen. Vibration or ultrasonic waves imparted by the generator reduces the viscosity of the slurry present in the vicinity of the screen 61 to ease the passage of the slurry through the screen 61. Further, due to the vibration, coarse particles which do not pass through the screen 61 easily overflow the screen. The vibration generator 72 may be independently provided. Alternatively vibration of the mill 11 may be utilized by transmitting it to the screen 61 by means of a switchable transmitting means. The slurry is passed through the screen 61 and transported as product through a discharge hole 62 to the outside of the system, and on the other hand, coarse particles which do not pass through the screen 61 overflow the screen 61 and enter, via a discharge hole 63, the recovery tank 65 where they are, as described above, mixed with water B and an additive liquid C, the resulting mixture being passed through the recovery pipe for coarse particle slurry 64 and sprayed within the mill. According to the above embodiment, since water and the additive to be fed to the mill is first fed to the recovery tank 65 and mixed with the coarse particle slurry, it is possible to reduce the solids concentration down to e.g. about 35% or less to thereby reduce its viscosity down to nearly that of water. Further, since the slurry is circulated via the recovery pipe 64 through the mill 11 by means of gravity flow, it is possible to continuously produce a CWM having a uniform quality. Further, as described above, when the additive is fed in the form of spray into the mill through the feed pipe 64 at the inlet of the mill and the feed pipe 70 at the exit and into the slurry tank 58 through a feed pipe 80, then it is possible to rationally add the additive and reduce its amount used.

In the above embodiment, the coarse particle slurry from the recovery tank 65 is returned to the mill 11 by means of gravity, but it is also possible to provide a pump midway and meter and feed the coarse particle slurry. When such a means is employed, the coarse particle slurry is metered and fed by means of a pump as in the case of the additive liquid, hence the influence according to the variation of the milling system is further reduced and it is possible to carry out a more stabilized operation.

Next, the specification of the ball mill and operating conditions suitable to the present invention will be deserbed.

In general, once the milling capacity of a ball mill is determined, how to determine the diameter D and the length L of the mill becomes important. Namely, according to the studies of the present inventors, the relationship between the milling capacity Q and the diameter D, the length L and the volume V of the mill is expressed by the following equation:

$$Q \propto VD$$

$$\propto \frac{\pi}{4} D^2 \cdot LD$$

Thus, when the diameter D or the length L of the mill is determined, others are inevitably determined; hence taking it into consideration, L/D whould be determine. Examples of L/D will be shown below. In the case of a cement-finishing mill wherein such an ultrafine milling that 99% of a milled material passes through 88 μm standard sieve is required, a mill having an L/D of 2.5 has been employed. Further, for fine milling in the case where CWM or COM is produced, a mill having an L/D of 2 to 3 has been employed. With regard to CWM, see Coal Water Slurry as Utility Boiler Fuel, EPRI-CS-2287, March, 1982, and with regard to COM, see Technical Results of EPDC's COM R & D, STEP 1 Laboratory Tests, March, 1978. Further, since it has been required as a necessary condition for CWM that coal particles be fine, the past general idea has resided in a thinking that in order to extend the retention time of coal particles, the length of the mill should be increased (i.e. L/D being made higher). In fact, as an apparatus for producing a CWM having a coal concentration of 70% by weight at a rate of 100 kg/h, from a coal having a HGI (coal grindability index (JIS Z 8801)) of 50, a ball mill of 570 mmϕ×1,710 mm L (L/D=3) was chosen and milling was carried out so as to give a 74 μm standard sieve pass of 70% by weight, but only a slurry having a slurry concentration of 69% by weight and a viscosity of 2,400 cP was obtained; thus it has been difficult to produce a CWM having a concentration of 70% by weight or more and a viscosity of 2,000 cP or less, from a coal having a HGI of ≦50. In general, as for coals used for boilers of thermal power stations, most of them have a grindability index (HGI) in the vicinity of 50; hence for the practical use of CWM, a CWM having a high concentration and a low viscosity is desirable.

Figure 9:
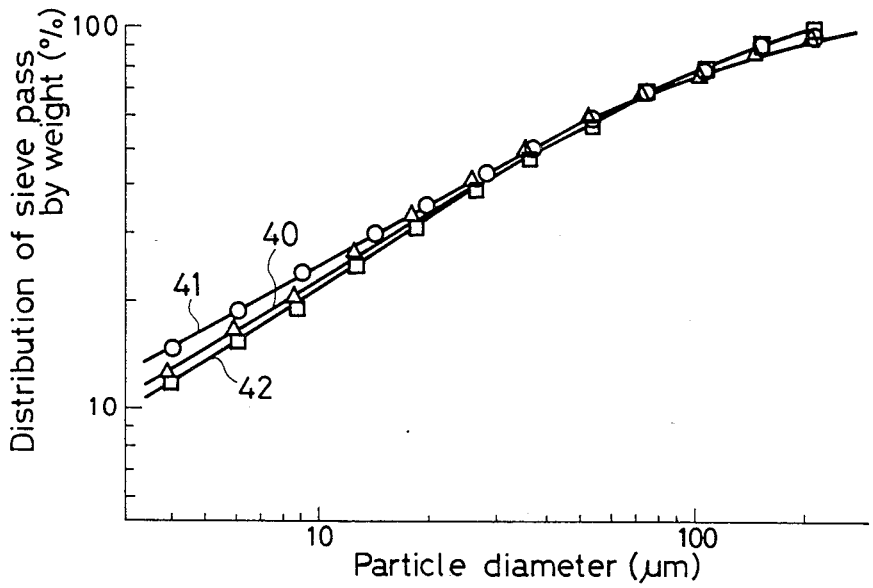
FIG. 9 shows a chart illustrating results of CWM production tests according to the prior art and the present invention.

In order to obtain a CWM having a higher concentration and a lower viscosity, the present inventors have studied the dimensions of ball mill, particularly the ratio of its length L to its inner diameter D (L/D), and as a result have found that L/D is preferred to be less than 2. The study results of L/D in the present invention will be described below. Using a ball mill having an inner diameter of 650 mm and a length of 1,250 mm (L/D=1.92), a coal having a HGI of 50 was milled into a slurry having a concentration of 70% by weight and containing a 74 μm standard sieve pass of 70% by weight. The experimental results are shown in Table 1 as production No. 1. In addition, results of an operation wherein a ball mill having an inner diameter of 550 mm and a length of 1,650 mm (L/D=3) was used for comparison are shown together in the table as production No. 3. Further, the viscosity distributions of the resulting slurries are shown in FIG. 9 wherein reference numeral 40 represents the case of production No. 1 and 42, the case of production No. 3. Further, a production experiment was similarly carried out using a two-compartment ball mill. The results are shown in the table as production No. 2, and as numeral 41 in FIG. 9.

TABLE 1

| No. | Slurry concentration (%) | Amount of CWM produced (kg/h) | Amount of additive added (%) | Power consumption (Kwh/T) | Viscosity (cP) |
|---|---|---|---|---|---|
| No. 1 | 70 | 101 | 1.2 | 42 | 1750 |
| No. 2 | 70 | 108 | 0.5 | 39 | 1400 |
| No. 3 | 69 | 101 | 1.2 | 42.6 | 2400 |

In comparison of No. 1 with No. 3 in Table 1, the coal concentration in the slurry was raised by 1% by weight, and nevertheless its viscosity could be reduced by 650 cP. Further in the case there a two-compartment mill was employed (No. 2), the coal milling capacity was increased by about 7% as compared with the case of No. 3 and the amount of additive added was 40% of those of the prior art, and nevertheless the viscosity was reduced by as large a valve as 1,000 cP. This is because, as shown in FIG. 9, when coal was milled so as to give a 74 νm standard sieve pass of 74% by weight, production No. 1 (numeral 40) gives a particle size distribution having a broader width than that in the case of No. 3 (numeral 42), and No. 2 (numeral 41) also gives a particle size distribution having a broader width than those in the case of No. 1 and No. 3. As a result, the packing density of particles is increased to attain a high concentration and a low viscosity of the slurry.

Figure 10:
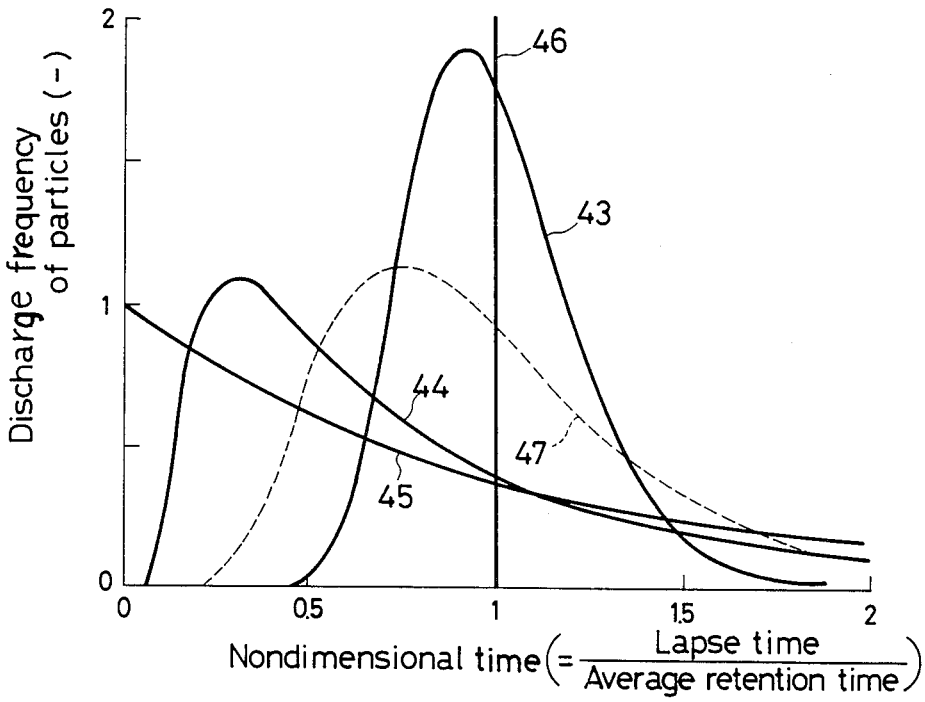
FIG. 10 shows a chart illustrating the retention time distribution of particles within the ball mill.

In order to elucidate the above results, the following studies were carried out:

With the mills employed in production No. 1 and No. 3, a tracer was dissolved in 50 cc of an additive solution. The resulting solution was introduced into the entrance of the mill in a short time of about one second, and sampling was intermittently carried out at the exit of the mill to analyze the tracer concentration and thereby determine the retention time distribution within the mill. FIG. 10 shows the retention time distribution of the tracer within the mill. Nondimensional time as a ratio of lapse time to average retention time is plotted along the abscissa axis, and discharge frequency of particles from the mill is plotted along the ordinate axis. In view of FIG. 10, it has been found that the retention time distribution 43 within a mill of L/D=3 is close to the distribution of extrusion flow (piston flow) 46, and the retention time distribution 44 within the mill of production No. 1 (L/D=1.92) is close to the distribution of complete mixing 45. In addition, when the retention time distribution 47 within a mill of L/D=2.1 was observed, it was similar to the distribution 43. Namely, it was found that the retention time distribution rapidly came close to that of extrusion flow when L/D was varied from 1.92 toward 2.1. Further, when the retention time distribution within a mill of L/D=1 (800 mm diameter×800 mm length) was observed, it accorded nearly with the distribution of the complete mixing 45 in FIG. 10. When a similar test was carried out with a mill of L/D=0.82 (850 mm diameter×700 mm length), the retention time distribution was almost the same as that of the complete mixing, but the proportion of coarse particles discharged increased. For example, in the case of 1≦L/D<2, the proportion of coarse particles was 1~2% or less, whereas in the case of L/D=0.8, the proportion of coarse particles increased to 5~10%. When CWM is used as a boiler fuel, coarse particles are apt to cause clogging the burner tip; hence it is desired to remove coarse particles by means of a strainer or the like and recycle coarse particles of 500~840μ or larger, for example, to the mill.

The number of times at which specified coal particles are milled in the mill is proportional to the retention time of the particles. Thus, in view of FIG. 10, it was found that for example, in the case of the mill of L/D=1.92 (production No. 1), since the pattern comes close to that of the complete mixing, particles which go out of the mill faster than the average retention time and particles which stay in the mill longer than the average retention time and hence have a chance of being milled oftener, both have a more number of times of being milled than those in the case of a mill of L/D=3. Accordingly, the particle size distribution of coal particles discharged from the mill of L/D=1.92 of production No. 1 has a broader width than that in the case of the mill of L/D=3. As described above, it has been clarified that one of the conditions necessary for producing a CWM having a high concentration and a low viscosity is to obtain a particle size distribution having a broad width, and that even in the case of mills having the same milling capacity, a mill having a small value of L/D, i.e. a mill having a large inner diameter and a short length is preferred. In view of the above results of studies, the range of L/D in the present invention is preferably $L/D<2$, more preferably $1 \leqq L/D \leqq 1.99$, most preferably $1 \leqq L/D \leqq 1.8$.

In general, the optimum rotating velocity of ball mills for dry milling or wet milling has been observed to be 65 to 80% of the critical velocity (e.g. R. H. Perry and C. H. Chilton, Chemical Engineerings' Handbook, 5th Edition, Mcgraw-Hill Book Co., 1973).

The above critical velocity Nc (a velocity at which centrifugal force and gravity of balls are well balanced and balls revolve together with the mill along the inner wall surface of the mill) is defined by the following equation:

$$Nc = 42.3\sqrt{D-d}\ \text{(rpm)}$$

wherein D represents the inner diameter (M) of the mill and d, the diameter of balls (M).

In the present invention, however, it has been found in view of the production capacity of coal, the power consumption and production of a coal-water slurry having a low viscosity, that the revolving number of the ball mill is preferred to be in the range of 45 to 64%, particularly 50 to 60% of the critical velocity.

Figure 11:
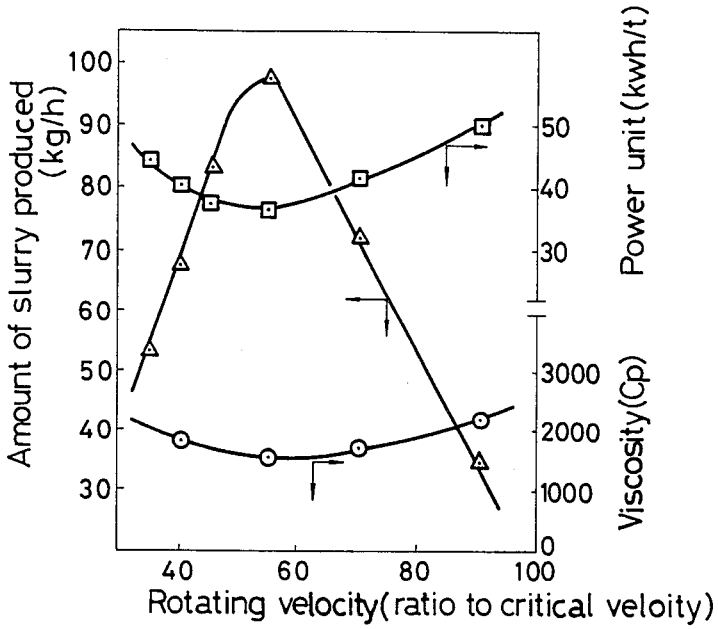
FIG. 11 shows a chart illustrating the effect of ball mill rotation velocity upon the power consumption of the ball mill and the slurry viscosity.
Figure 12:
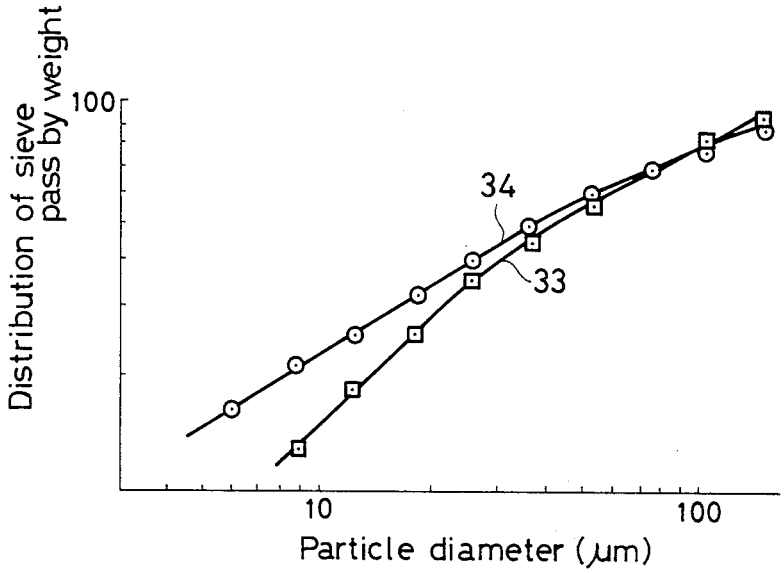
FIG. 12 shows a chart illustrating the particle size distribution of a high concentration coal-water slurry.

Namely FIG. 11 shows a data obtained when, with a continuous ball mill of 650 mm diameter and 1,250 mm length, coal having a Hardgrove grinability (HGI, JIS-M8801) of 50 was milled in a high concentration manner in a coal concentration of 72% by weight and operation was carried out so as to give a particle size distribution shown in FIG. 12 as numeral 34, that is, so as to give a 200 mesh pass of 70% by varying the amount of coal fed and the amount of liquid added in accordance with the revolving velocity of the mill. In FIG. 11, symbol o represents the plot of viscosity, symbol □, the plot of power consumption, and symbol Δ, the plot of rotating velocity. In FIG. 12, numeral 33 represents a particle size distribution in the case where a wet milling was carried out in a coal concentration of 50% by weight. In view of these results, it has been found that in the case of a Nc of 45 to 64%, preferably 50 to 60%, the production capacity by slurry amounts to about 80% or more and also the power consumption and the viscosity are more reduced.

Further, the present inventors have made studies on the operation conditions of the wet ball mill and the grindability of coal, and as a result have found that the particle size distribution of coal fed to the mill and the diameter of coal particles contained in the CWM obtained after milling have a correlationship with the diameter of balls filled into the mill. As a result it has been found that balls filled into the mill are preferred to have a diameter of 1.5 to 7.5 times the largest diameter of roughly ground coal fed.

When balls having a diameter in the above range are used, it is possible to take a large value of the velocity constant (milling velocity constant) at which roughly ground coal is milled, that is, to improve the milling efficiency; hence for example, it is possible to obtain a CWM which does not contain coal particles of 0.5 mm or more in diameter becoming a cause of burner clogging and yet contains coal particles of 1 μm or less in diameter being favorable for making the viscosity lower even in a high concentration, in an amount of 10% or more.

The largest diameter of roughly ground coal fed to the above ball mill has no particular limitation, but in general, the diameter is preferably 20 mm or less, particularly 10 mm or less.

Figure 13:
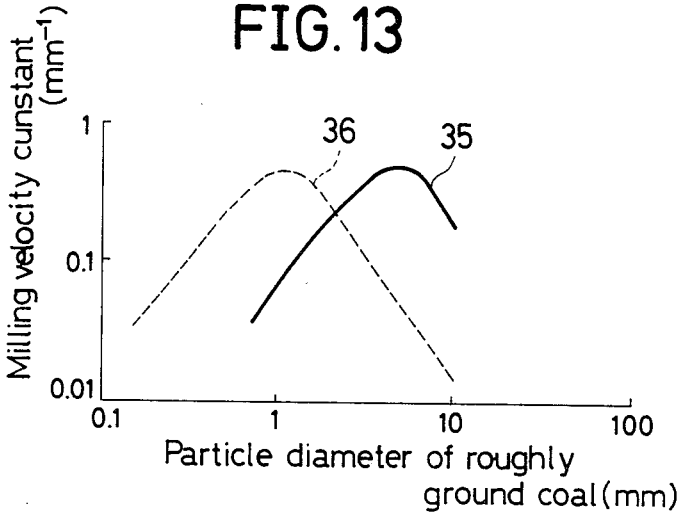
FIG. 13 shows a chart illustrating the effect of the diameter of balls filled in the wet ball mill upon the milling velocity of coarsely ground coal.
Figure 14:
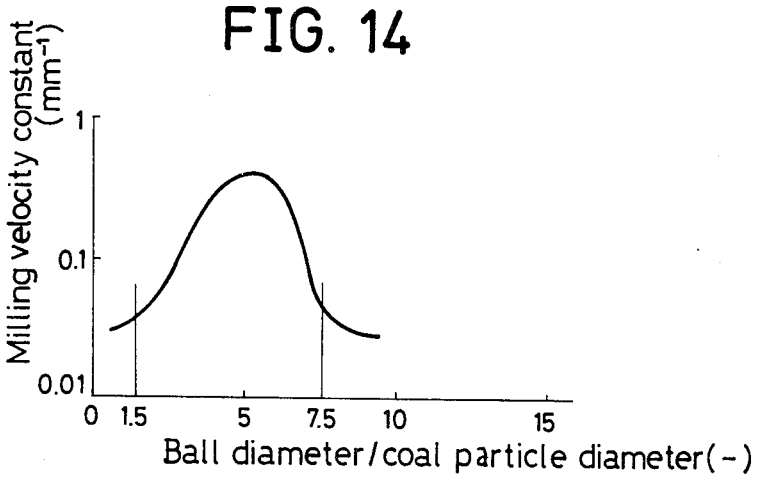
FIG. 14 shows a chart illustrating the effect of the ratio of ball diameter to coal particle diameter upon the milling velocity constant of coal at the time of milling.

In order to observe what influence the diameter of balls within a wet tube mill has upon the particle size distribution of roughly ground coal fed to the ball mill and the particle size distribution of coal contained in the slurry obtained by operation of the mill, the diameter of balls within the ball mill was varied to seek the milling velocity constant of coal. The results are shown in FIG. 13. In this figure, reference numerals 35 and 36 represent a case of a larger ball diameter and that of a smaller ball diameter, respectively. As seen from FIG. 13, when roughly ground coal fed has a larger particle diameter, the milling velocity constant becomes greater in the case of the larger ball diameter (numeral 35), while when the roughly ground coal has a smaller particle size, the milling velocity constant becomes greater in the case of the smaller ball diameter (numeral 36). Further, based on these results, the relationship between the particle size of roughly ground coal and the ball diameter was put in order, and as a result the results shown in FIG. 14 were obtained. In view of this figure, it has been clarified that when the ratio of the ball diameter to the particle diameter of roughly ground coal is in the range of 1.5 to 7.5, it is possible to take a large value of the milling velocity constant.

Figure 15:
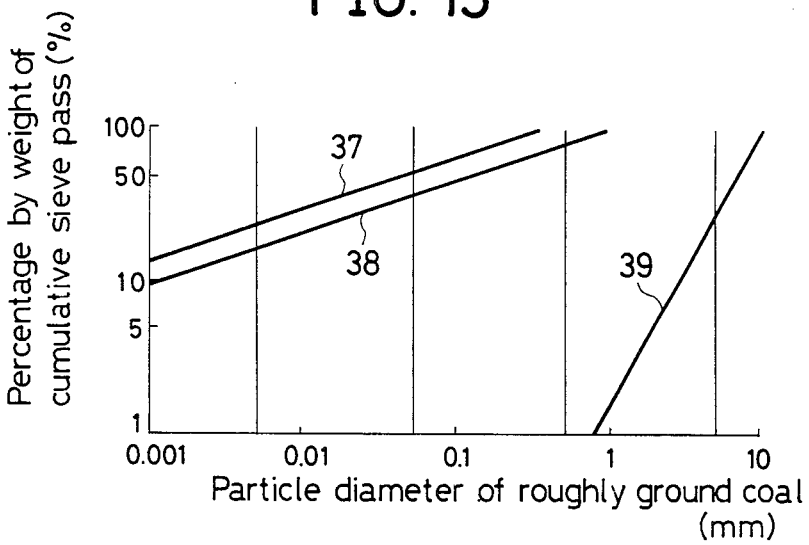
FIG. 15 shows a chart illustrating the distribution of coal particles contained in a CWM produced according to an embodiment of the present invention.

Numeral 37 in FIG. 15 shows the particle diameter distribution of a CWM obtained by feeding 20 kg of coal roughly ground to a size of 10 mm or less into a ball mill containing balls of 30 to 75 mm in diameter at a percentage packing of 30% under addition of 8.57 kg of water, followed by fine milling. In this figure, numeral 39 shows the particle diameter distribution of roughly ground coal fed to the mill. As apparent from FIG. 15, the particle diameter of coal particles contained in the resulting CWM is 0.5 mm (at most) or less, on the other hand, milling was carried out in the same matter as above except that the diameter of balls filled in the mill was changed to 75~80 mm. The particle diameter of coal particles contained in the resulting CWM was as shown in the figure as numeral 38, that is, the presence of coal of 0.5 mm or more in diameter was observed.

In the present invention, it is preferred to circulate a portion of the coal-water slurry obtained by milling in the ball mill, via the outside of the mill again to the mill. In order to effect this, a distributor may be provided wherein a portion of the coal-water slurry leaving the mill is mixed in a coal flow to be introduced into the mill. When this means is employed, the coal particles contained in the circulated coal-water slurry can be remilled and pulverized to obtain a broader particle size distribution.

Figure 16:
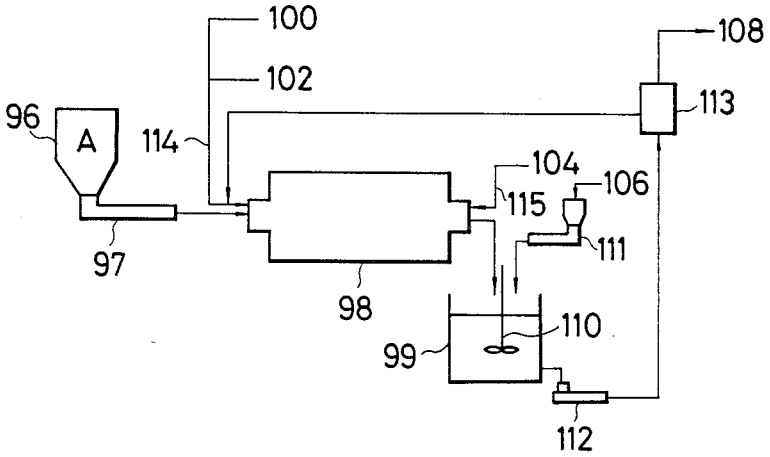
FIG. 16 shows a view illustrating the system of a CWM production apparatus wherein a distributor is provided at a location outside the mill and a portion of CWM leaving the mill is recycled.

FIG. 16 shows a view illustrating the system of a apparatus for producing the coal-water slurry, as an embodiment of the present invention wherein a distributor is provided as described above. In this figure, a coal feeder 97 is connected to the inlet port of a ball mill 98 wherein steel balls of about 50~20 mm in diameter occupy 35% of the volume of the mill, and a feed pipe 114 for additive liquid (water 100 and a dispersing agent 102) is opened into the mill at its inlet part. Further, another feed pipe 115 for additive liquid is opened into the mill at its exit part. Below the mill exit is provided a slurry tank 99 into which an additive is fed through a feeder 111 and mixed by an agitator 110. The slurry adjusted in the slurry tank 99 is transferred by a pump 112 to a distributor 113 where a portion of the slurry is distributed and returned to the mill 98 and the remainder is taken out as product. An example of the distributor 113 is a distributing feeder. As for the distributor 113, any form may be employed solong as it can distributed the coal-water slurry as it is.

In the above system of the apparatus, coal roughly ground to e.g. about 5 mm or less is metered and fed from a bunker 96 via a coal feeder 97 to a mill 98. An additive liquid containing a dispersing agent, etc. is fed through the pipe 114 to the inlet part of the mill so as to give a coal concentration of about 75 to 85% by weight based on the raw material coal. Within the mill 98, coal particles are pulverized due to impact, shear and friction effects between balls or against the immer wall of the ball mill, and flow toward the mill exit. Fresh surface of particles newly formed therein is effectively wetted by the addive contained in the additive liquid fed through the feed pipe 115 for the liquid on the side of the mill exit. Further, the slurry containing particles having fresh surface formed by milling is discharged from the mill 98 and stored in the slurry tank 99 wherein the slurry is effectively mixed with the additive fed through the feeder 111 by means of the stirrer 110. The slurry transferred from the tank 99 by means of a pump 112 is distributed by the distributor 113. A portion of the slurry is circulated to the mill 98 and remilled therein and the remainder is taken out as product.

Figure 17:
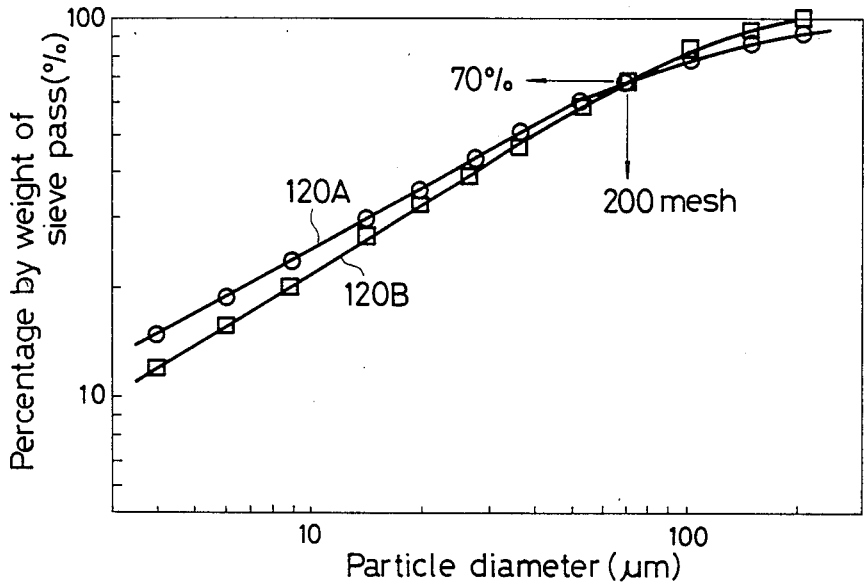
FIG. 17 shows a chart illustrating comparison of the results of CWM production tests by way of the apparatus system of the prior art and that shown in the above FIG. 16.

FIG. 17 shows the results of production of a coal-water slurry according to the process of the present invention shown in FIG. 16. In this figure, reference numeral 120A shows a case where milling was carried out up to a 200 mesh pass of 70% in the mill of 650 mm in diameter, followed by returning twice the amount of product to the mill by the distributor 113. Reference numeral 120B shows a case where after the above milling, the slurry was not returned to the mill, but the whole of the slurry was recovered as product slurry. As shown in this figure, when a portion of the product slurry is circulated to the mill, particles are remilled to give a slurry having a particle diameter distribution wherein a larger amount of particles are contained below 200 mesh. In comparison of the viscosity and coal concentrating of the slurry of 120A with those of the slurry of 120B, the slurry of 120B had a viscosity of 2,200 cP in a coal concentration of 68% by weight, whereas the slurry of 120A had a viscosity of 1,800 cP in a coal concentration of 70% by weight. Further, the amount of the dispersing agent used was reduced from 1.3% by weight (in the case of 120B) down to 0.6% by weight (in the case of 120A) based on the weight of coal. The reason is that a multistage addition system was employed wherein the additive was added as milling proceeded to form fresh surface of particles, and the additive was effectively contacted and mixed with particles.

In a general dry or wet ball mill apparatus, a closed circuit milling system has been employed wherein a classifier is provided outside the mill and classified fine powder is recovered as product, while coarse powder is returned to the mill (for example, see Unit Operation of Chemical Engineering, W. L. Mccabe and J. C. Smith, Chapter 26, Mcgraw-Hill, 2nd edition, New York, 1967). The reason why the closed circuit milling system is employed is that by taking out fine powder, formed by milling, to the outside of the system, overmilling is avoided and power consumption is reduced.

In the present invention, by carrying out milling in a close circuit system wherein a distributor is provided which does not have any classifying function, and has not been employed in a conventional coal milling apparatus, it is possible to obtain a broader particle size distribution having a broader width to thereby produce a coal-water slurry having a higher concentration and a lower viscosity.

In the present invention, by first carrying out a wet milling of coal by means of a ball mill in a high coal concentration, followed by adding water to the resulting coal-water slurry, it is possible to obtain a coal-water slurry having a lower viscosity as product. In this case, the coal content in the ball mill i.e. the coal concentration in the coal-water slurry at the mill exit is preferably 75 to 80% by weight, and water may be added so as to give a coal concentration in the resulting diluted coal-water slurry, of 50 to 70% by weight, preferably 65 to 70% by weight.

The following Table 2 shows comparison results of case where coal was milled by a wet ball mill, followed by adding water (Experiment No. 1) with a case where after the above milling, no water was added (Experiment No. 2). As apparent from this Table, although the coal concentrations in these two slurries are both 70% by weight, the slurry viscosity of Experiment No. 1 is 80 cP, that is, reduced to a large extent as compared with 1,500 cP of Experiment No. 2.

TABLE 2

| Condition | Experiment No. No. 1 | Experiment No. No. 2 |
|---|---|---|
| Coal concentration at the time of milling | 75% | 70% |
| Amount of water added at the mill exit | 5% | 0% |
| Coal concentration at the mill exit | 70% | 70% |
| Slurry viscosity | 80 cP | 1500 cP |

Further, the cumulative percentages as to the respective slurries obtained in Experiments No. 1 and No. 2 were observed. As a result, it was found that the coal particles contained in the slurry obtained in Experiment No. 1 had a particle size distribution having a broader width than that of the slurry of Experiment No. 2. This is presumed to be because the slurry of Experiment No. 1 had a higher coal concentration in the mill than that of Experiment No. 2 and hence coal particles in Experiment No. 1 were milled under more suitable condition for milling.

Figure 18:
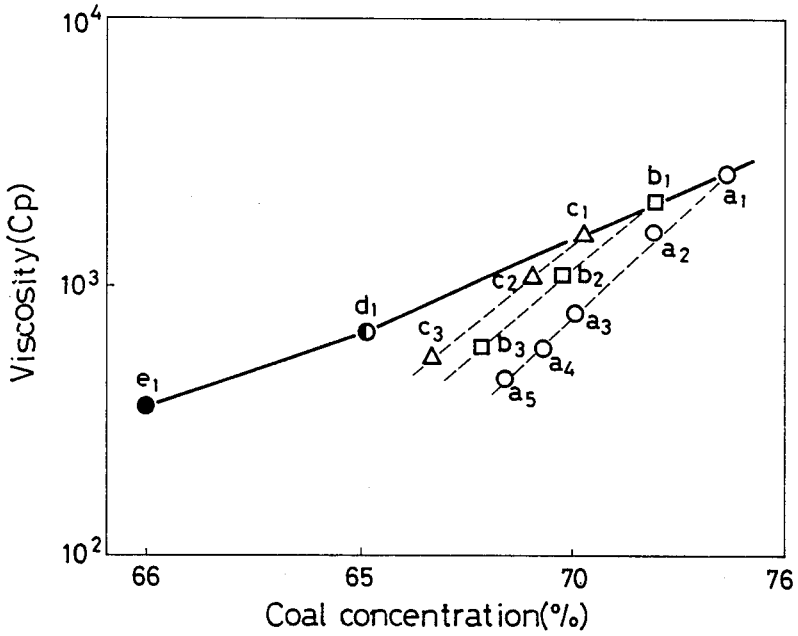
FIG. 18 shows a chart illustrating the relationship between the concentration and viscosity of various coal-water slurries obtained according to the present invention.

FIG. 18 shows changes in slurry viscosity observed in the case where coal was milled while the coal concentration at the time of milling was varied within a range of 60 to 75%, and in the case where after the above milling, water was added to vary the slurry concentration. The change in the former case is shown by $a_1 \sim a_5$, $b_1 \sim b_3$, and $c_1 \sim c_3$ on the dotted lines.

In view of the results shown in this figure, it was found that a slurry obtained by adding water to a slurry prepared by milling in a coal concentration of 70% or more and preferably 73% or more so as to give a concentration of about 70% has a notably reduced viscosity and is suitable to handling at the time of transportation, storage, etc.

The present invention will be concretely described by way of Examples.

EXAMPLE 1

In the apparatus shown in FIG. 6, there was employed as the mill 11, a cylindical body 12 having an inner diameter of 650 mm and a length of 1,250 mm and provided with a partition plate 18 at a location 50 cm distant from the mill inlet, and according to the process of the present invention, a coal having a HGI of 50 was milled in its high concentration to produce a high concentration coal-water slurry having an ultimate slurry concentration of 70% and a 200 mesh pass of 70% (No. 2). On the other hand, a coal-water slurry having the same concentration and particle size was produced employing the same apparatus as above except that the partition plate 18 and the secondary feed pipe for dispersing agent 21 were both not provided (No. 1). The amount of slurry produced per hour, the amount of dispersing agent used, the power unit consumption and the viscosity of product slurry in the above two cases (No. 1 and No. 2) are shown in Table 3. Further, the particle size distribution of product slurry (distribution of sieve pass by weight) is shown in FIG. 10.

TABLE 3

| Production process | Amount of slurry produced | Amount of dispersing agent used | Power consumption | Slurry* concentration |
|---|---|---|---|---|
| No. 1 | 108 kg/h | 0.5 part by weight | 39 Kwh/T | 1400 cP |
| No. 2 | 101 kg/h | 1.2 part by weight | 42 Kwh/T | 1750 cP |

*The above slurry viscosities are values obtained by using a Brookfield RUT type viscometer, rotating the spindle at 100 rpm and measuring the viscosity at a slurry temperature of 25° C.

As seen from Table 3, according to the production process of No. 1, the amount of slurry produced per hour, i.e. the amount of coal milled per hour increased by about 7%, and as a result the power consumption decreased by 7% as compared with those of No. 2. Further, the amount of dispersing agent used in No. 1 was only about 40% of that in No. 2, and nevertheless the viscosity could be reduced by 15%.

EXAMPLE 2

Coal-Water slurries having an ultimate concentration of 70% same as in Example 1 were produced as in Example 1 except that various coals having HGI values other than that of Example 1 were used. With regard to the relationships of the slurry viscosity and power consumption with HGIs of the coals, the results of the above process of No. 1 were compared with those of No. 2. As a result it was found that the power consumption of the process of No. 2 decreased by about 7% and the slurry viscosity lowered by about 15~20%, as compared with those of No. 1.

EXAMPLE 3

A slurry having a coal concentration of 70% was produced in the same manner as in Example 1 except that a limestone feeder was provided in the apparatus employed in Example 1, as shown in FIG. 7, a coal having a HGI of 45 was used as raw material coal, and one part by weight of limestone was added to 100 parts by weight of coal in the primary compartment. When the coal was slurried according to the production process of No. 1, the resulting slurry viscosity was 1,900 cP due to the use of limestone, as compared with the slurry viscosity of about 2,300 cP at a coal concentration of 70% in the Example 2.

What we claim is:

1. A process for producing a high concentration coal-water slurry in a continuously operating ball mill having a plurality of stage compartments respectively having different size balls, with the stages separated from each other by partition means through which the coal-water slurry passes, said method comprising:

feeding coal and water into a continuously operating ball mill wherein the ratio (L/D) of the length of the mill (L) to the diameter thereof (D) is less than 2;

passing the coal-water slurry serially through the plurality of stages in a milling direction, so that a broader width of particle size distribution is obtained than if L/D were greater than 2, resulting in less viscosity and a higher coal concentration; and adding a dispersing agent separately and directly into each of a plurality of the stages in the milling direction of the coal within the ball mill, in amounts adjusted to the surface area of the coal at each stage, so that less dispersing agent is used than if it were all added at once when obtaining the same coal concentration and so that a greater coal concentration is obtained than if the dispersing agent were all added at once when obtaining the same viscosity.

2. A process according to claim 1, wherein the respective compartments contain balls having diameters which successively through wear become smaller from the compartment of the inlet side of the mill toward that on the exit side thereof; the adjacent compartments are partitioned by a perforated partition plate the holes of which have a diameter somewhat smaller than that of the normally smallest ball within the upstream compartment.

3. A process according to claim 2, wherein at least one of limestone and a limestone-water slurry is added to at least one of said compartments, and the mixture is mixed with coal and milled together therewith so that fine limestone powder is formed to fill the interstices between coal particles to increase the packing density to obtain a higher slurry concentration and reduce the viscosity.

4. A process according to claim 1, wherein the ratio L/D is preferably $1 \leqq L/D \leqq 1.99$.

5. A process according to claim 4, wherein the ratio L/D is preferably $1 \leqq L/D \leqq 1.8$.

6. A process according to claim 1 wherein the rotating velocity of the ball mill is 45 to 64% of the critical velocity of the mill.

7. A process according to claim 1 wherein the rotating velocity of the ball mill is 50 to 60% of the critical velocity of the mill.

8. A process according to claim 1, wherein the coal-water slurry flowing out of the ball mill is classified by a classifier and a slurry containing particles coarser than a definite particle size is returned to the ball mill, while a slurry containing particles of a definite particle size of smaller is taken out as product.

9. A process according to claim 1, wherein balls inside the ball mill have diameters of 1.5 to 7.5times the largest diameter of roughly ground coal fed to the ball mill.

10. A process according to claim 9, wherein the largest diameter of roughly ground coal fed to the ball mill is 20 mm or less.

11. A process according to claim 1, wherein a portion of the coal-water slurry prepared by the wet milling by means of the ball mill is circulated to the ball mill and remilled therein.

12. A process according to claim 11, wherein said dispersing agent is also added to the slurry at a location outside the ball mill.

13. A process according to claim 1, wherein the milling of coal is first carried out in a state where a high concentration of coal is contained, followed by adding water to the resulting high concentration coal-water slurry.

14. A process according to claim 13, wherein the coal concentration at the time of coal milling is in the range of 70 to 80% by weight.

15. A process according to claim 13, wherein the coal concentration in the coal-water slurry is brought within a range of 65 to 70% by weight by the addition of water.

* * * * *